US005407059A

United States Patent [19]

Fochler

[11] Patent Number: 5,407,059

[45] Date of Patent: Apr. 18, 1995

[54] ADJUSTABLE CARTON CONVEYOR FOR PACKING MACHINE

[75] Inventor: Fritz Fochler, Senden, Germany

[73] Assignee: Uhlmann Pac-Systeme GmbH & Co. KG, Laupheim, Germany

[21] Appl. No.: 238,620

[22] Filed: May 4, 1994

[30] Foreign Application Priority Data

May 4, 1993 [DE] Germany ..... 43 14 632.5

[51] Int. Cl.[6] ..... B65G 15/14

[52] U.S. Cl. ..... 198/626.5; 198/803.11; 198/803.13; 198/817

[58] Field of Search ..... 198/473.1, 484.1, 626.5, 198/803.11, 803.13, 817

[56] References Cited

U.S. PATENT DOCUMENTS

| | | | |
|---|---|---|---|
| 3,325,977 | 6/1967 | Kirsten | 198/817 |
| 4,641,742 | 2/1987 | Igarashi et al. | 198/626.5 |
| 5,145,053 | 9/1992 | Krieger et al. | 198/626.5 |

FOREIGN PATENT DOCUMENTS 4036510 5/1992 Germany .

*Primary Examiner*—Joseph E. Valenza
*Attorney, Agent, or Firm*—Herbert Dubno; Andrew Wilford

[57] ABSTRACT

A conveyor has a pair of outer and a pair of inner endless conveyor elements having parallel conveying stretches extending in a transport direction, and respective rows of holders on the conveyor elements with the holders of the outer elements offset in the direction from the holders of the inner elements and the holder element of each inner and outer element aligned transversely with the respective holder of the other inner and outer element. A main shaft journaled at one end of the stretches defines a main axis and respective pairs of inner and outer sprockets on the main shaft guide the respective conveyor elements around the main shaft. One of the inner sprockets and one of the outer sprockets are axially fixed on the main shaft and the other inner sprocket and the other outer sprocket are displaceable axially along the main shaft. Only one of the pairs of sprockets is rotationally coupled to the main shaft. A secondary shaft is spaced from and parallel to the main shaft. A clutch is closable for coupling the secondary shaft to the main shaft for joint synchronous rotation and openable for relative rotation of the main and secondary shafts. Respective wheels on the main shaft are coupled to the sprockets of the other pair for joint rotation therewith and are both rotationally coupled to the secondary shaft. Respective wheels on the secondary shaft are aligned with and coupled to the respective main-shaft wheels.

11 Claims, 2 Drawing Sheets

ADJUSTABLE CARTON CONVEYOR FOR PACKING MACHINE

FIELD OF THE INVENTION

The present invention relates to a conveyor. More particularly this invention concerns an adjustable carton conveyor for a packing machine or the like.

BACKGROUND OF THE INVENTION

In a standard packing operation such as described in copending application Ser. No. 08/229,324, filed Apr. 18, 1994 and Ser. No. 08/233,233, filed Apr. 26, 1994 flattened cartons are erected by an apparatus and deposited in respective cells of a conveyor. The erected boxes are then moved past a packing machine that loads the contents into them and they are sealed and shipped out.

Such an operation, which for instance is used in a manufacturing operation, must be capable of accommodating cartons of different sizes so that, when a production line is switched, cartons of the appropriate size can be used. The erecting machine can be set to pick off and set up the differently sized cartons. German patent document 4,036,510 describes such a conveyor which has three chains each carrying a succession of abutments, with three abutments defining a seat or cell for receiving a single respective carton. The chains are parallel and pass over respective coaxial sprockets spaced axially apart on a common shaft. The sprockets of the two outer chains are axially fixed relative to each other while the sprocket of the center chain is mounted on a sleeve that is movable angularly on the shaft so that it can be angularly displaced and fixed, thereby adjusting the spacing between the center abutments and the flanking side abutments in the transport direction. A motor mounted on the rotating shaft effects the necessary adjustment.

Adjusting such a system is not simple. The motor, which must be energized through a system of commutator rings, is prone to failure. In addition the use of only three holders means that a carton can easily get canted in its holder, making it difficult or impossible to pack. What is more the relative adjustability is limited by how much the sleeve of the central sprocket can move angularly on the sprocket shaft, typically only 90°, so that very small or very large boxes cannot be accommodated.

OBJECTS OF THE INVENTION

It is therefore an object of the present invention to provide an improved conveyor for a carton-packing machine.

Another object is the provision of such an improved conveyor for a carton-packing machine which overcomes the abovegiven disadvantages, that is which can easily be adjusted to accommodate a wide range of carton sizes and that provides solid four point holding of the cartons.

SUMMARY OF THE INVENTION

A conveyor has according to the invention a stationary frame, a pair of outer and a pair of inner endless conveyor elements having parallel conveying stretches extending on the frame in a transport direction with the stretches of the inner elements lying between the stretches of the outer elements, and respective rows of holder members on the conveyor elements with the holder members of the outer elements offset in the direction from the holder members of the inner elements and the holder element of each inner and outer element aligned transversely with the respective holder of the other inner and outer element. A common main shaft journaled in the frame at one end of the stretches defines a main axis and respective pairs of inner and outer sprockets on the main shaft guide the respective conveyor elements around the main shaft. One of the inner sprockets and one of the outer sprockets are axially fixed on the main shaft and the other inner sprocket and the other outer sprocket are displaceable axially along the main shaft. One of the pairs of sprockets is rotationally coupled to the main shaft and the other pair of sprockets is rotatable relative to the main shaft. A secondary shaft on the frame is spaced from and parallel to the main shaft. A clutch is closable for coupling the secondary shaft to the main shaft for joint synchronous rotation and openable for relative rotation of the main and secondary shafts. Respective main-shaft wheels on the main shaft are coupled to the sprockets of the other pair for joint rotation therewith and are both rotationally coupled to the secondary shaft. Respective secondary-shaft wheels on the secondary shaft are aligned with and coupled to the respective main-shaft wheels.

Thus with this arrangement each carton can be held by four of the holder members, so that it will be accurately positioned. The lateral spacing, that is horizontally perpendicular to the transport direction, of the holder members can be adjusted as can the spacing in the transport direction. Due to the construction of the structure making the adjustment in the transport direction possible, it is possible for the adjustable holder members to be displaced the full distance between succeeding fixed holder members, thereby accommodating very small and very large cartons.

All that the user needs to do to adjust for longer boxes is open the clutch and rotate the secondary shaft, then close the clutch when the desired setting is achieved. The adjustment for transverse spacing is wholly independent of this longitudinal adjustment and is typically done by means of a threaded spindle.

According to further features of the invention the housing includes a stationary plate in which the shafts are journaled and to which the one inner sprocket, one outer sprocket, and the respective secondary-shaft wheel are axially fixed, and a movable plate displaceable axially relative to the fixed plate and carrying the other inner sprocket, other outer sprocket, and the respective secondary-shaft wheel. At least one transversely extending guide member fixed to the stationary plate supports the movable plate.

The sprockets and wheels in accordance with this invention have tubular hubs on the respective shafts and provided with bearings supporting the hubs on the respective plates. In addition the hubs of the outer sprockets are supported on the hubs of the respective inner sprockets. These shaft wheels are coupled to each other by respective toothed belts.

The transmission according to the invention has a main-shaft coupling wheel fixed to the main shaft, a secondary-shaft coupling wheel rotatable on the secondary shaft and couplable rotationally to the secondary shaft by the clutch, and an endless transmission element between the two coupling wheels. Once again the endless transmission element is a toothed belt.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
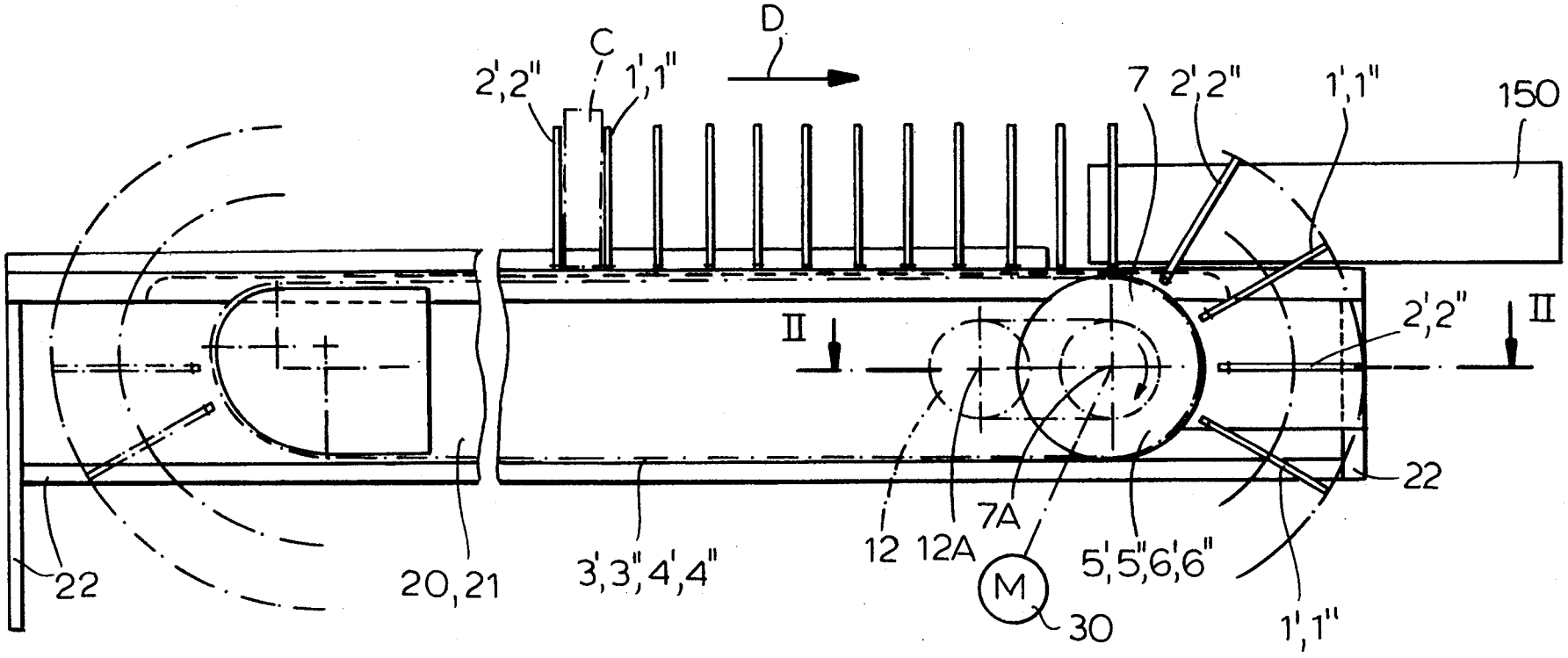
FIG. 1 is a largely schematic side view of the system of this invention.
Figure 2:
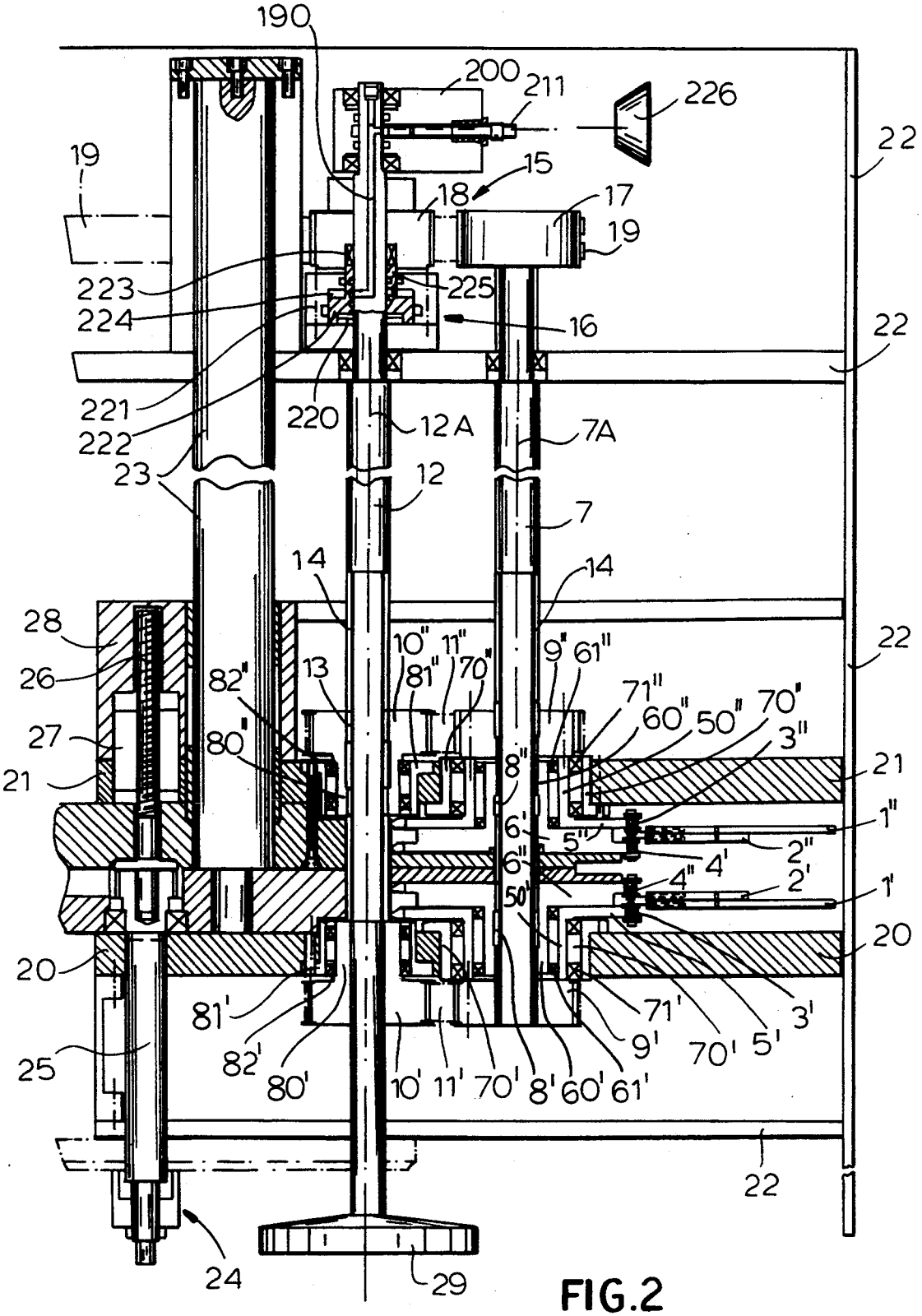
FIG. 2 is a larger-scale horizontal section taken along line II—II of FIG. 1.

As seen in FIGS. 1 and 2 a conveyor according to this invention has a housing 22 with a main fixed and longitudinally extending plate 21 and another plate 21 that also extends longitudinally in a travel direction D but that is movable transversely and horizontally in the housing 22. Two outer chains 3' and 3" carry outer holder leading bars 1' and 1" and two inner chains 4' and 4" carry inner trailing holder bars 2' and 2". Each group of four bars 1', 1", 2', and 2" defines a seat adapted to receive a respective carton as indicated at C in FIG. 1, with the bars 2' and 2" behind the carton C and the bars 1' and 1" in front of it. At their downstream ends, the chains 3', 3", 4', and 4" are spanned over respective sprockets 5', 5", 6', and 6" carried on a common shaft 7 defining an axis 7A that is horizontal and perpendicular to the direction D. At the downstream end of the upper reaches of the chains 3', 3", 4', and 4" the cartons C are picked off the conveyor by a takeoff belt or device 150. A motor 30 rotates the shaft 7 to advance the holders 1', 1", 2' and 2" in the normal travel direction D.

The sprockets 5' and 6' are axially fixed relative to the shaft 7 and to each other while the sprockets 5" and 6" are axially displaceable on the shaft 7 along the axis 7A. Keys 8' and 8" riding in grooves 14 in the shaft 7 rotationally couple the sprockets 6' and 6" to the shaft 7 and to each other while permitting the sprocket 6" to move axially along the shaft 7.

The sprockets 5' and 5", which can rotate relative to the axis 7A on the shaft 7, are fixed to respective pulleys or wheels 9' and 9" connected via toothed belts 11' and 11" to further such pulleys or wheels 10' and 10" that are axially slidable on a shaft 12 extending along an axis 12A parallel to the axis 7A. Further keys 13 riding in grooves 14 of the shaft 12 permit the wheel 10" to move axially along this shaft 12 synchronously with the wheel 9" and sprocket 5".

The sprockets 6' and 6" have tubular collar hubs 60' and 60" on which tubular collar hubs 50' and 50" of the sprockets 5' and 5" are supported by roller bearings 61' and 61". In turn the housing plates 20 and 21 carry flanges 70' and 70" that support the collars 50' and 50" via further roller bearings 71' and 71". The plate 21 is slidable horizontally, transverse to the direction D on at least one massive guide rod 23 whose ends are seated in the plate 20 and housing 22. Similarly, the wheels 10' and 10" have tubular collar hubs 80' and 80" which are supported by bearings 82' and 82" in sleeves 81' and 81" set in the plates 20 and 21. An adjuster 24 has a spindle 25 with a threaded shaft 26 engaged in a nut 27 limitedly displaceable in a holder 28 fixed on the plate 21. Thus as the spindle 25 is rotated in one direction the plate 21 will move away from the plate 20, taking the sprockets 5" and 6" as well as the wheels 9" and 10" with itself. Clearly there can be several such rods 23 and several such adjusters 24, the latter interconnected by a chain or toothed belt for joint synchronous rotation. This makes it possible to adjust the spacing of the holder bars 1' and 2' from the holder bars 1" and 2" parallel to the axis 7A, accommodating cartons C of different widths.

As mentioned above, the sprockets 6' and 6" are not rotationally coupled to the shaft 7; instead they are coupled by the respective wheels 9', 9", the belts 11' and 11", and wheels 10' and 10" to the shaft 12. This shaft 12 in turn can be coupled to the shaft 7 by a transmission 15 including a clutch 16. More particularly, the shaft 7 carries a pulley or wheel 17 connected via toothed belts 19 to another toothed wheel 18 rotatable on the shaft 12 but couplable thereto by the clutch 16. This clutch 16 has a housing 221 in which a clutch body 222 is urged axially by a washer-spring pack 220 to push a coupling body 225 into teeth 223 formed in the wheel 18 to couple the shaft 12 to the wheel 18 and through the transmission 18 to the shaft 7 for joint synchronous rotation. A chamber 224 of the clutch 16 can be pressurized via a passage 190 in the shaft 12 from a rotary fitting 200 having a line 211 connected to a source 226 of air under pressure to disengage the parts 223 and 225 from each other and allow the shafts 7 and 12 to rotate relative to each other.

The shaft 12 carries a hand wheel 29 so that, when the chamber 224 is pressurized, the shaft 12 can be rotated to adjust the angular position of the sprockets 6' and 6" on the shaft 7. This compensates for cartons C of different lengths.

Thus to adjust the width of the cell or seat for a carton C, the adjuster 24 is actuated to move the elements 1" and 2" transversely from the minimum-size position of FIG. 2 to the desired spacing. Then to adjust for carton length in the direction D the clutch 16 is pressurized to open it, and the hand wheel 29 is actuated to displace the holders 2' and 2" relative to the holders 1' and 1", although of course it would be possible to use a motor to rotate the shaft 12.

We claim:

1. A conveyor comprising:

a stationary frame;

a pair of outer and a pair of inner endless conveyor elements having parallel conveying stretches extending on the frame in a transport direction with the stretches of the inner elements lying between the stretches of the outer elements;

respective rows of holder members on the conveyor elements with the holder members of the outer elements offset in the direction from the holder members of the inner elements and the holder element of each inner and outer element aligned transversely with the respective holder of the other inner and outer element;

a common main shaft journaled in the frame at one end of the stretches and defining a main axis;

respective pairs of inner and outer sprockets on the main shaft guiding the respective conveyor elements around the main shaft, one of the inner sprockets and one of the outer sprockets being axially fixed on the main shaft;

means on the frame for displacing the other inner sprocket and the other outer sprocket axially along the main shaft;

means including formations rotationally coupling one of the pairs of sprockets to the main shaft, the other pair of sprockets being rotatable relative to the main shaft;

a secondary shaft on the frame spaced from and parallel to the main shaft;

transmission means including a clutch closable for coupling the secondary shaft to the main shaft for joint synchronous rotation and openable for relative rotation of the main and secondary shafts;

respective main-shaft wheels on the main shaft and coupled to the sprockets of the other pair for joint rotation therewith and both rotationally coupled to the secondary shaft;

respective secondary-shaft wheels on the secondary shaft aligned with the respective main-shaft wheels; and means coupling the secondary-shaft wheels with the respective main-shaft wheels.

2. The conveyor defined in claim 1 wherein the housing includes a stationary plate in which the shafts are journaled and to which the one inner sprocket, one outer sprocket, and the respective secondary-shaft wheel are axially fixed, and a movable plate displaceable axially relative to the fixed plate and carrying the other inner sprocket, other outer sprocket, and the respective secondary-shaft wheel.

3. The conveyor defined in claim 2 wherein the sprockets and wheels have tubular hubs on the respective shafts and provided with bearings supporting the hubs on the respective plates.

4. The conveyor defined in claim 3 wherein the hubs of the outer sprockets are supported on the hubs of the respective inner sprockets.

5. The conveyor defined in claim 1 wherein the means coupling the shaft wheels with each other includes respective toothed belts.

6. The conveyor defined in claim 1 wherein the transmission means includes:

a main-shaft coupling wheel fixed to the main shaft, a secondary-shaft coupling wheel rotatable on the secondary shaft and couplable rotationally to the secondary shaft by the clutch, and an endless transmission element between the two coupling wheels.

7. The conveyor defined in claim 6 wherein the endless transmission element is a toothed belt.

8. The conveyor defined in claim 1, further comprising a hand wheel fixed on the secondary shaft for, when the clutch is open, rotating the secondary shaft and thereby displacing the other pair of sprockets angularly on the main shaft relative to the one pair of sprockets.

9. The conveyor defined in claim 1 wherein the holder members are bars projecting substantially perpendicularly from the respective conveyor elements.

10. The conveyor defined in claim 1 wherein the conveyor elements are chains.

11. The conveyor defined in claim 1 wherein the outer sprockets are the other pair of sprockets that is not angularly fixed on the main shaft.

* * * * *